US005908016A

United States Patent [19]

Northam et al.

[11] Patent Number: 5,908,016

[45] Date of Patent: Jun. 1, 1999

[54] CARBON FIBER REINFORCED CARBON COMPOSITE ROTARY VALVES FOR INTERNAL COMBUSTION ENGINES

[75] Inventors: G. Burton Northam, Carrollton; Philip O. Ransone, Gloucester; H. Kevin Rivers, Hampton, all of Va.

[73] Assignee: The United States of America as represented by the Administrator of the National Aeronautics and Space Administration, Washington, D.C.

[21] Appl. No.: 08/812,826

[22] Filed: Mar. 6, 1997

Related U.S. Application Data

[ 60] Provisional application No. 60/013,306, Mar. 6, 1996.

[51] Int. Cl.[6] ..... F01L 7/16

[52] U.S. Cl. ..... 123/190.17; 123/190.8

[58] Field of Search ..... 123/190.1, 190.4, 123/190.6, 190.8, 190.17

[56] References Cited

U.S. PATENT DOCUMENTS

| | | | |
|---|---|---|---|
| 1,975,777 | 10/1934 | Bournonville | 123/190.6 |
| 4,010,727 | 3/1977 | Cross et al. | 123/190.4 |
| 4,370,955 | 2/1983 | Ruggeri | 123/190.6 |
| 4,683,809 | 8/1987 | Taylor . | |
| 4,736,676 | 4/1988 | Taylor . | |
| 4,894,286 | 1/1990 | Gray | 428/408 |
| 4,909,133 | 3/1990 | Taylor . | |
| 5,052,349 | 10/1991 | Buelna | 123/190.6 |
| 5,083,537 | 1/1992 | Onofrio et al. . | |
| 5,154,147 | 10/1992 | Muroki | 123/190.4 |
| 5,255,645 | 10/1993 | Templeton | 123/190.4 |
| 5,315,969 | 5/1994 | Macmillan | 123/190.6 |
| 5,370,087 | 12/1994 | Guimond et al. . | |
| 5,490,485 | 2/1996 | Kutlucinar | 123/190.4 |
| 5,524,579 | 6/1996 | Eluchans | 123/190.6 |
| 5,526,780 | 6/1996 | Wallis | 123/190.6 |
| 5,536,574 | 7/1996 | Carter | 428/381 |
| 5,654,059 | 8/1997 | Hecht | 428/65.9 |

*Primary Examiner*—Erick R. Solis
*Attorney, Agent, or Firm*—Kurt G. Hammerle

[57] ABSTRACT

Carbon fiber reinforced carbon composite rotary, sleeve, and disc valves for internal combustion engines and the like are disclosed. The valves are formed from knitted or braided or warp-locked carbon fiber shapes. Also disclosed are valves fabricated from woven carbon fibers and from molded carbon matrix material. The valves of the present invention with their very low coefficient of thermal expansion and excellent thermal and self-lubrication properties, do not present the sealing and lubrication problems that have prevented rotary, sleeve, and disc valves from operating efficiently and reliably in the past. Also disclosed are a sealing tang to further improve sealing capabilities and anti-oxidation treatments.

2 Claims, 5 Drawing Sheets

CARBON FIBER REINFORCED CARBON COMPOSITE ROTARY VALVES FOR INTERNAL COMBUSTION ENGINES

CLAIM OF BENEFIT OF PROVISIONAL APPLICATION

Pursuant to 35 U.S.C. § 119, the benefit of priority from provisional application Ser. No. 60/013,306 with a filing date of Mar. 6, 1996, is claimed for this non-provisional application.

ORIGIN OF THE INVENTION

The described invention was made by employees of the United States Government and may be manufactured and used by the government for government purposes without the payment of any royalties thereon or therefor.

BACKGROUND OF THE INVENTION

1. Technical Field

This invention relates to rotary, sleeve and disc valves made of carbon fiber reinforced carbon composite materials, for use in internal combustion engines and the like.

2. Description of the Related Art

Current internal combustion, 4-cycle engines use metal poppet valves. While 2-cycle engines still use reed, disc, and rotary valves, stricter air pollution standards are causing manufacturers to turn to poppet valves even for these engines. Most poppet valves are cast, forged, or machined from billets of metal. These valves are inherently heavy and have poor structural properties at higher temperatures. By design, poppet valves must reciprocate: starting from a full stop and accelerating to very high speeds, only to be brought to a stop again and reaccelerated and brought again to a stop at the place it started. Due to their significant mass, metallic valves develop substantial inertia as engine speed (revolutions per minute or "RPM") increases. Almost all production poppet valves are restrained by metallic springs. However, as RPM increases, the spring's ability accurately to restrain the poppet valve's travel is overwhelmed by the valve's inertia and it "floats". This tendency to float inhibits the engine's ability to reach higher RPM, where more power can be produced more efficiently.

Over the years, many poppet valves have been designed to control valve motion, even at high RPM. Ducati Mechanic, Spa., the Italian manufacturer of road and racing motorcycles, uses a fully mechanical poppet valve opening and closing, "desmodromic" system. The efficacy of this design has never been conclusively established and it is an extremely expensive system to manufacture and maintain. Electrically operated poppet valves are currently being tested, but they have not yet been shown successfully to operate at even moderately high RPMs. International Formula 1 racing teams have in recent years employed pneumatic springs to overcome the limitations of metal springs. It is not clear when or if these designs will be put into production engines, but it will be recognized that these systems do not avoid the basic problem: poppet valves must reciprocate.

In production engines, the tendency of poppet valves to float is compensated for by the use of increasingly stiff springs. However, increasing spring stiffness also increases the work the engine must perform just to open the valves, and this in turn results in significant power drain. Moreover, poppet valve systems are major contributors to the overall noise produced by an engine. Stiffer springs tend to result in noisier valve trains. More efficient and powerful and quiet engines could be designed if a satisfactory alternative to the poppet valve could be found.

Another inherent problem with poppet valves is the fact that they stand directly in the path of the intake and exhaust charges they are meant to admit and discharge. Over the years almost every variation in combustion chamber shape, valve position, and manifold design has been tried to maximize the amount of charged fuel that can flow past a poppet valve into the chamber. The current trend has been to give the intake charge (and, to a lesser extent, the exhaust charge as well) as straight a path as possible into the combustion chamber. Nevertheless, the poppet valve still stands in the way. The ability of an engine to admit a charge efficiently could be significantly improved if an unblocked path into the combustion chamber could be designed.

Another inherent problem with metallic poppet valves is that they quickly lose strength as temperatures increase. Low cost, commodity steel poppet valves used in the overwhelming majority of combustion engines are limited to exhaust gas temperatures in the 1500 to 1750 degree Fahrenheit range. Combustion efficiencies could be improved and undesirable emissions reduced if exhaust gas temperatures could be raised beyond this level.

Over the years engineers have proposed the use of rotary, sleeve, and disc valves to overcome the inherent limitations of the poppet valve. The basic design of these valves is to rotate a valve body to expose and close intake and exhaust ports. In this way, the need to reciprocate a poppet valve is avoided. There are three very general designs of rotary valves: cylindrical, sleeve, and disc. One type of cylindrical rotary valve is open at each end and separated inside by a wall, creating two chambers, each ported to the combustion chamber through windows in the side of the cylinder. Another type of cylindrical rotary valve is substantially solid and has in its sides one or more recesses that expose the combustion chamber to a manifold. These two types of cylindrical rotary valves have axes of rotation that are perpendicular to the cylinder. Another type of rotary valve has its axis of rotation parallel to the cylinder. One such type is in the general shape of a cone, the base of which is exposed to the combustion chamber. A port from the base and through the side of the cone permits gases to be admitted or expelled. The sleeve valve is in the shape of a cylinder and also acts as the cylinder in which the piston reciprocates. The sleeve valve rotates, and in some cases also reciprocates, exposing ports. The disc valve can operate in substantially the same manner as the cone-shaped rotary valve, or it can operate at different positions, such as at the side of the cylinder, as is the general practice with 2-cycle disc valves. Rotary valves in 4-cycle engines have never seen volume production. Sleeve valves have been used in production aero engines, but have never gained wide favor.

The principal of these valve designs is that the rotary valve and the surface it rides in must be very closely mated in order adequately to seal the combustion chamber, but as engine temperatures rise the different expansion rates of these metallic parts leads either to sealing problems, if the parts are not close enough, or to seizure, if they are too close. An additional defect of these designs is that they are difficult to lubricate and when they are adequately lubricated they tend to admit lubricating oil into the combustion chamber, leading to undesirable emissions. Moreover, if a metallic rotary valve is used to discharge exhaust gases it will tend to become extremely hot and difficult to lubricate.

The present invention overcomes the traditional problems associated with rotary, sleeve, and disc valves by constructing them of a carbon fiber reinforced carbon composite ("CFRCC") material, as more fully described below.

SUMMARY OF THE INVENTION

Accordingly, one object of the present invention is to provide improved rotary, sleeve and disc valves for internal combustion engines and the like.

Another object is to provide rotary, sleeve, and disc valves that will mate closely with a valve housing, even at high temperatures.

Another object is to provide rotary, sleeve, and disc valves that will be self lubricating.

Another object is to provide a rotary, sleeve, and disc valve that will have a low mass.

Another object is to provide a rotary, sleeve, and disc valve that will be quiet.

Another object is to provide a rotary, sleeve, and disc valve that will enhance fuel and air mixture by using the valve's rotation to aid fuel atomization and combustion chamber swirl.

According to the present invention, the foregoing objects and advantages are obtained by providing rotary, sleeve, and disc valves that are formed from a predominately carbon matrix material. It is possible to mate rotary, sleeve, and disc valves very closely to the housings in which they rotate and thus overcome the principal problem associated with the metallic counterparts. Moreover, increased engine efficiency and emission reductions are now achieved. Also, it is now possible to operate at high speeds without the lubrication problems experienced with metallic equivalents. Such a CFRCC rotary, sleeve, or disc valve simultaneously overcomes the inherent shortcomings of reciprocating poppet valves as well as those of metal rotary, sleeve, or disc valves.

Carbon fiber reinforced carbon matrix composites are composed of carbon fibers embedded in a carbonaceous matrix. Although the fibers and matrix are both made of carbon, this does not homogenize the mechanical behavior of the composite because the state of the microstructure may range from carbon to graphite. Graphite consists of tightly bonded, hexagonally arranged carbon layers. The hexagonal bonds are extremely strong, but the layers are held together by weak van der Waals forces. But, carbon can also take a number of quasi-crystalline forms, ranging from an amorphous or turbostratic glassy carbon to the highly crystalline graphite and even to the strongest diamond structure. This anisotropy of the graphite single crystal encompasses many structural forms of carbon. It ranges in the degree of preferred orientation of the crystallites and influences porosity. In CFRCC's the range of properties can extend to both the fibers and the matrix. Using a variety of techniques, great flexibility exists in the design and properties that can be obtained.

In general, fiber reinforced composites have the advantages of high specific strength, stiffness, and in-plane toughness. CFRCC's combine these advantages with the refractory properties of structural ceramics. Thus, CFRCC's retain these mechanical advantages as well as high thermal stability, superior to any other material. These properties may be tailored to a unique application by specifying the orientation of carbon fibers and by the use of additives or treatments applied to the fibers or matrix.

In the operation of internal combustion engines, lubricating oil is required to allow metallic poppet, rotary, sleeve, and disc valves to slide or rotate within their guides. This results in some oil entering the combustion chamber and in turn disturbing the fuel and air mixture, leaving deposits on the pistons, valve faces, and combustion chambers, and increasing hydro-carbon emissions. However, CFRCC valves according to the present invention are self-lubricating and eliminate the need for oil in this area, thereby reducing emissions. These efficiencies are also aided by the very low thermal coefficient of expansion for CFRCC valves according to the present invention. Since these valves do not expand as much as equivalent metal parts, it is possible to run parts with much tighter tolerances, which results in better sealing and reduced oil passage into the combustion chamber.

CFRCC valves according to the present invention require anti-oxidation treatments when they are to operate at temperatures above 600 degrees Fahrenheit in the presence of oxygen. Anti-oxidation technology is well developed to satisfy aerospace applications. Ceramic coatings, such as silicon carbide or silicon nitride may be applied by chemical vapor deposition or sputtering, or catalytic coatings, such as nickel, may be applied by electro plating. Other treatments impregnate the carbon fibers with liquid precursors, chemically modifying the carbon matrix, and treating the materials by chemical vapor infiltration. Adding borate glass-forming powders to chemically modify the carbon matrix material is also an effective and simple anti-oxidation treatment.

A significant feature of CFRCC valves according to the present invention is their substantially reduced mass compared to metals. The principal goal of rotary, sleeve, and disc valves is to substitute undamped rotational motion for the poppet valve's heavily damped reciprocating motion. The use of CFRCC rotary, sleeve, and disc valves according to the present invention achieves this goal and improves upon it by significantly reducing the mass of the valve train components. By doing this it is possible for an engine to reach higher RPM's than can be reached by conventional poppet valve engines. For a given size engine, more power can be produced at higher RPM. For this reason small engines and racing engines are designed to operated at elevated RPM's. Thus, light CFRCC rotary, sleeve, and disc valves according to the present invention can make smaller, more fuel efficient engines able to achieve the same power as bigger, gas-guzzling engines.

A CFRCC valve according to the present invention is also able to operate at significantly higher temperatures. Low cost, commodity steel poppet valves used in the overwhelming majority of internal combustion engines are limited to exhaust gas temperatures in the 1500 to 1750 degree Fahrenheit range. Combustion efficiencies could be improved and undesirable emissions reduced if exhaust gas temperatures could be raised beyond this level. A CFRCC valve according to the present invention can operate safely up to at least 2500 degrees Fahrenheit.

DETAILED DESCRIPTION OF THE INVENTION

Figure 1:
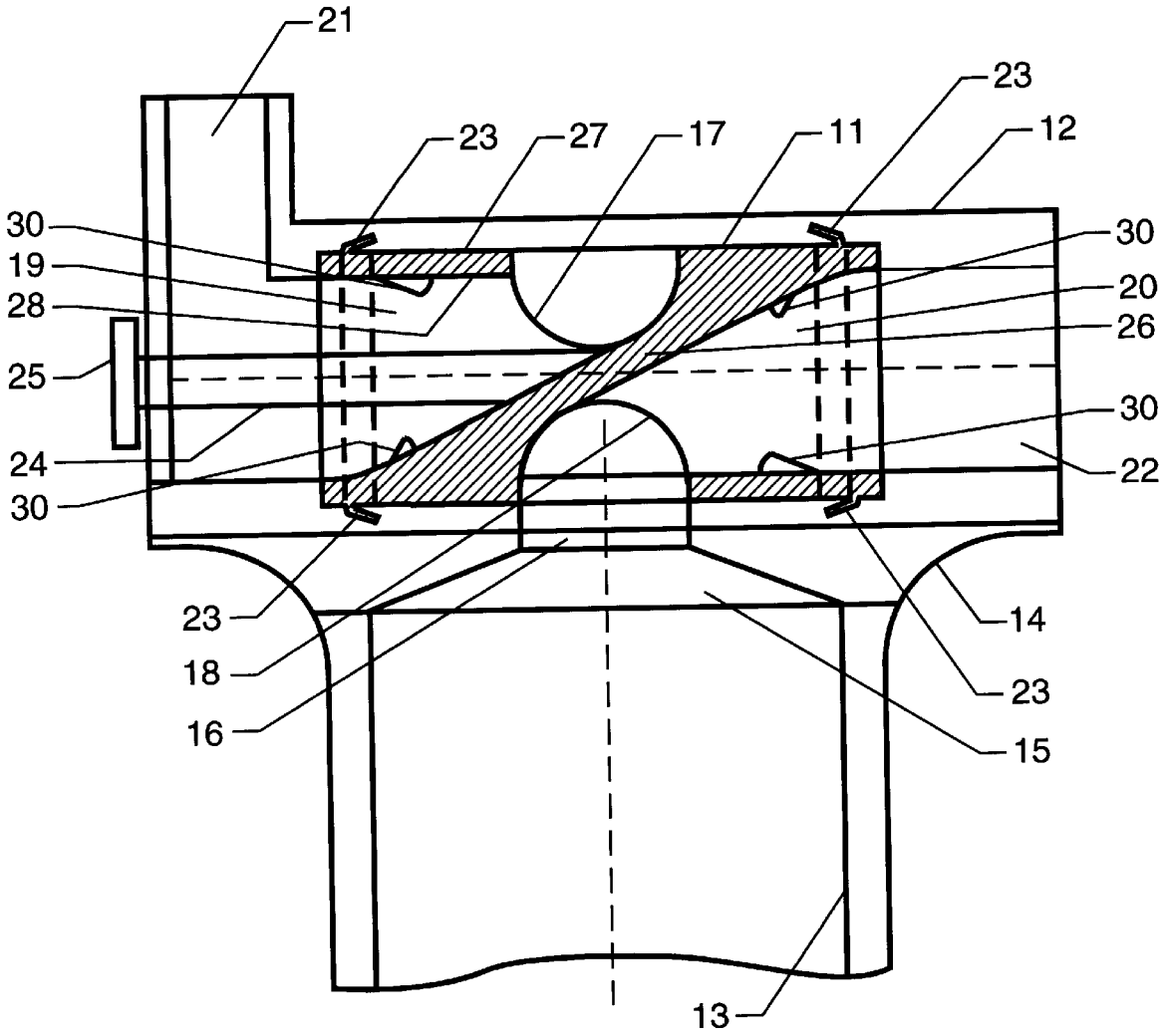
FIG. 1 is a cross section side view of an open-cylinder rotary valve fabricated according to the disclosed invention.

FIG. 1 shows one form of a rotary valve, this one being an open-cylinder design. This design has an open-cylinder rotary valve body 11 rotatably seated in a cylindrical housing 12. According to the present invention, the open-cylinder body 11 is fabricated from a predominately carbon matrix material. In a preferred embodiment of this invention, the cylindrical housing 12 is also fabricated from a predominately carbon matrix material. The open-cylinder body 11 is divided by an interior wall 26 into two chambers, an inlet chamber 19 and an outlet chamber 20. Each of these chambers, 19 and 20, opens at each end of the open-cylinder body 11. In the open-cylinder body 11 are two ports, an inlet port 17 and an exhaust port 18, each communicating with their respective chambers, 19 and 20. The inlet chamber 19 is open to the intake manifold 21, and the exhaust chamber 20 is open to the exhaust manifold 22. The open-cylinder body 11 is connected to one end of a drive shaft 24, and at the other end is attached a drive gear 25 which transmits timed motion to this valve train from the engine. The cylindrical housing 12 is connected to the cylinder head 14 which is connected to the cylinder 13. The combustion chamber 15 is formed by the cylinder 13 and the cylinder head 14. A combustion chamber port 16 is formed in the cylinder head 14 and the cylindrical housing 12. As the open-cylinder body 11 rotates in its cylindrical housing 12 the inlet port 17 and exhaust port 18 are at different times exposed to the combustion chamber port 16 thereby allowing fuel and air to be drawn in and expelled from the combustion chamber 15.

The novelty of the rotary valve design described above is the fact that it is fabricated from a predominately carbon matrix material. The open-cylinder body 11 is easily constructed out of this material. To achieve the greatest strength and to permit the greatest control over the strength of particular regions, the open-cylinder body 11 should be formed from a knitted or braided or warp-interlock tube of carbon fibers. Woven carbon fiber cloth could also be used to form the open-cylinder body 11, but knitting or braiding or warp-interlock techniques have the advantage of extending continuous carbon fibers throughout the three-dimensional tube structure, whereas layers of woven cloth are stacks of two-dimensional sheets without any shared fibers between the layers. With either a knitted or woven carbon fiber structure, the fibers may be preimpregnated with a carbonaceous resin system that will fill voids during curing. The open-cylinder body 11 could also be cast in a mold with a carbonaceous resin, but this provides the least strong carbon composite structure. The carbonaceous resin may contain discontinuous or random fibers for some added strength. The preform knitted, woven, or cast open-cylinder body 11 is then placed in a mold and cured. At this stage additional carbonaceous resin system material may be added to the part or injected into the mold to further densify the carbon structure. Since carbon composite materials tend to be porous, one or more densification steps are necessary to finish the part. Also during this densification process, the surface of the part may be treated to give the surface a self-lubrication capability. Finally, the open-cylinder body 11 is removed from the mold and any final machining may be performed by conventional methods. During the densification stages or after finishing, the open-cylinder body 11 may, in a preferred embodiment of the invention, be treated to prevent oxidation. Such treatment includes silicon carbide and silicon nitride ceramic coatings (not shown) applied by chemical vapor deposition or sputtering, or a nickel catalytic coating (not shown) applied by electroplating. Another such treatment would be the chemical vapor infiltration of a borate glass-forming powder into the carbon fibers and/or the carbon matrix material.

In a preferred embodiment of the invention the cylindrical housing 12 is also fabricated from a predominately carbon matrix material. The cylindrical housing 12 in which the open-cylinder body 11 rotates may be constructed by similar methods to those discussed above. The finished carbon composite cylindrical housing 12 is inserted into the cylinder head 14, which may be made of a more conventional material.

Figure 2:
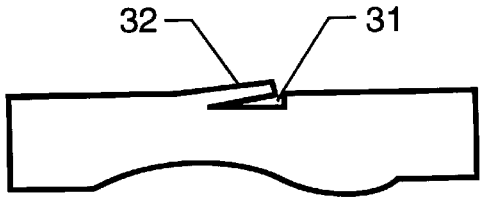
FIG. 2 is a cross section side view of a rotary valve seal according to the disclosed invention.

In a preferred embodiment of this invention, radial seals 23 are formed around the outer surface 27 of the open-cylinder body 11. FIG. 2 shows the cross-section detail of a seal 23. Each seal 23 is formed in the predominately carbon matrix material by molding or cutting into it a L-shaped, radial slot 31 around the circumference of the outer surface 27. The L-shaped slot 31 forms a tang 32 which protrudes slightly from the outer surface 27 of the open-cylinder body 1 1. The tang 32 thus forms the seal 23 radially around the open-cylinder body 11. The object of the seal 23 is to prevent gases from being forced out of the combustion chamber 15 through the space between the cylindrical housing 12 and the open-cylinder body 11. When the tang 32 is directed toward the combustion chamber port 16, any gases being forced out during combustion will be directed and expand into the L-shaped slot 31 causing the tang 32 to be forced outward, further improving sealing capability.

In another preferred embodiment of this invention, a plurality of vanes 30 are disposed on the inlet chamber surface 28. These vanes 30 serve to improve air and fuel mixture by encouraging atomization. The vanes 30 further serve to improve combustion efficiency by giving the intake charge desirable swirl.

Figure 3:
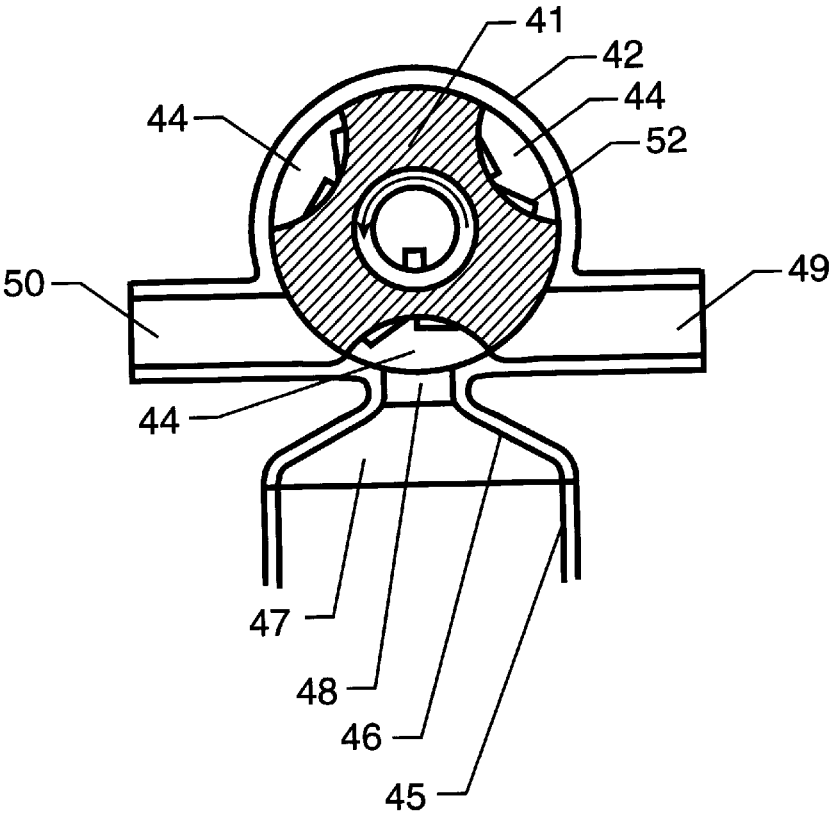
FIG. 3 is a cross section head-on view of a closed-cylinder rotary valve fabricated according to the disclosed invention.
Figure 4:
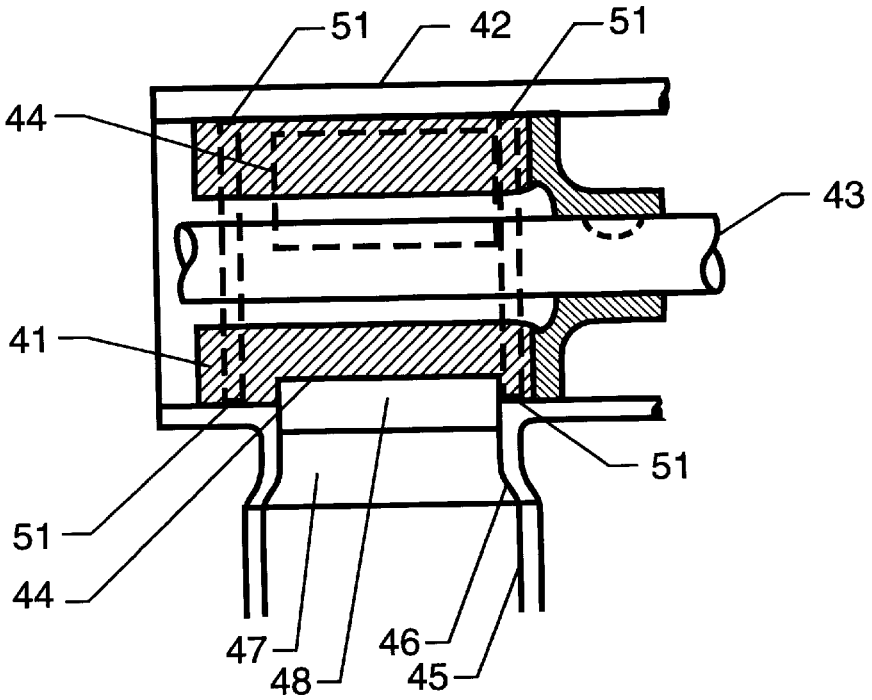
FIG. 4 is a cross section side view of a closed-cylinder rotary valve fabricated according to the disclosed invention.

FIGS. 3 and 4 show different views of a distinct type of rotary valve, this one being a closed-cylinder design. This design has a closed-cylinder rotary valve body 41 rotatably seated in a cylindrical housing 42. According to the present invention, the closed-cylinder body 41 is fabricated from a predominately carbon matrix material. In a preferred embodiment of this invention, the cylindrical housing 42 is also fabricated from a predominately carbon matrix material. The closed-cylinder body 41 has at least one recessed port 44 formed by a circumferential cavity. The closed-cylinder rotary valve shown in FIGS. 3 and 4 has three recessed ports 44. With such a design the valve will turn at one-sixth the engine speed. The cylindrical housing 42 sits atop or is part of the cylinder head 46 and the cylinder 45. The cylinder 45 and cylinder head 46 form a combustion chamber 47. Through the cylindrical housing 41 and the cylinder head 46 is a combustion chamber port 48. The closed-cylinder body 41 is axially aligned and rotated by a drive shaft 43. As the closed-cylinder body 41 rotates, the recessed ports 44 expose the combustion chamber port 48 alternately to the inlet manifold 49 and the exhaust manifold 50, thereby allowing fuel and air to be drawn in and expelled from the combustion chamber 47.

The novelty of the closed-cylinder rotary valve described above is the fact that it is fabricated from a predominately carbon matrix material. As with the open-cylinder rotary valve body described above, the closed-cylinder body 41 is best fabricated from a knitted or braided or warp-interlock tube having continuous carbon fibers throughout the three-dimensional dimensional structure. However, it may also be formed from woven carbon fiber cloth or cast from a carbonaceous matrix system. The processing steps described above also apply here for curing, densification, self-lubrication treatment, and anti-oxidation treatment.

In a preferred embodiment of this invention, the closed-cylinder rotary valve cylindrical housing 42 is also formed from a predominately carbon matrix material, using the fabrication methods described above. In another preferred embodiment of this invention, radial seals 51 are formed around the closed-cylinder body 41. FIG. 2 shows the detail of such a seal, which is described more fully above. In another preferred embodiment of this invention, vanes 52 are formed in the recessed ports 44 in order to improve atomization and swirl.

Figure 5:
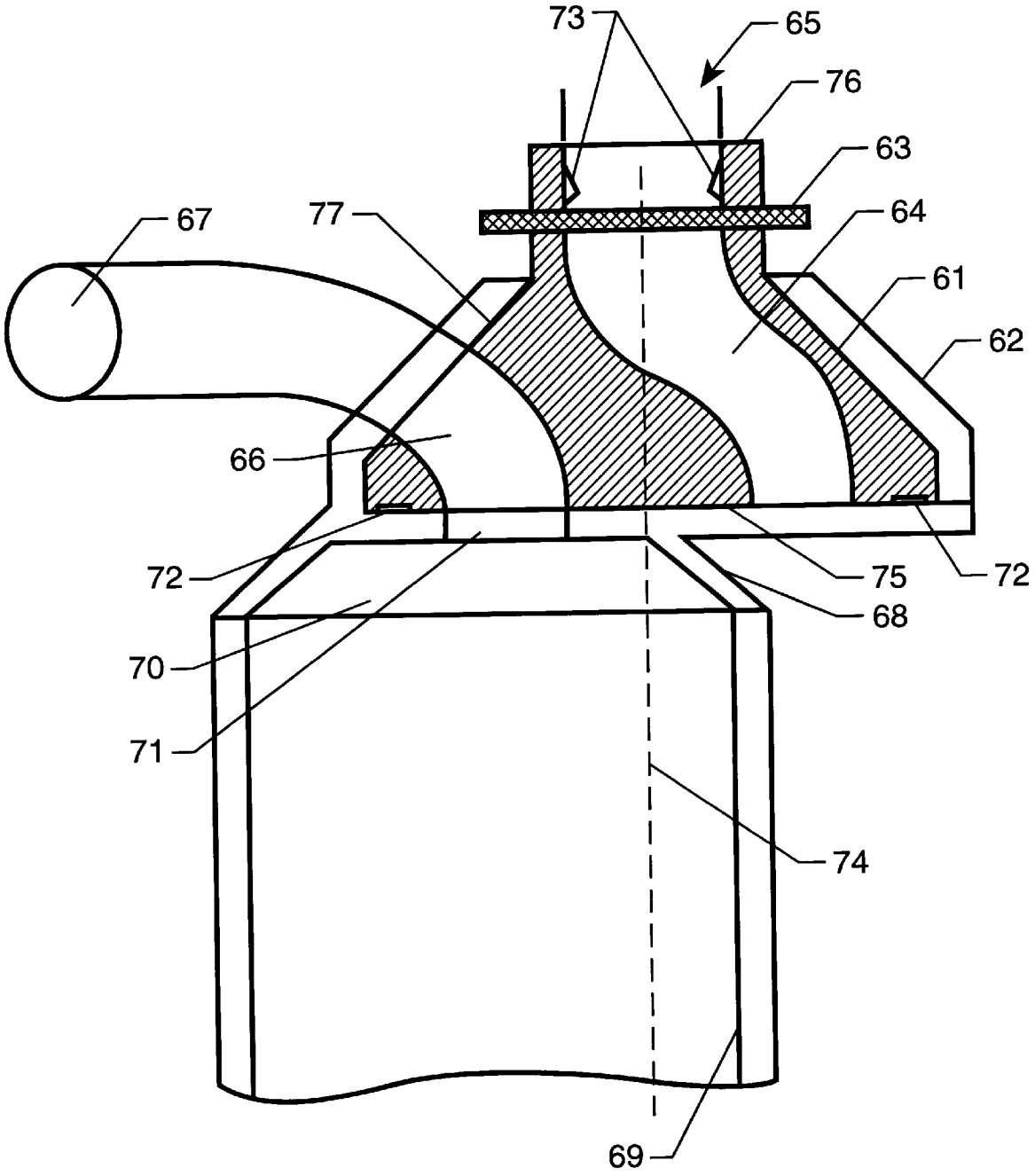
FIG. 5 is a cross section side view of a conical rotary valve fabricated according to the disclosed invention.

FIG. 5 shows a distinct type of rotary valve, this design having a substantially conical shape. This design comprises a conical rotary valve body 61 rotatably seated in a conical housing 62. According to the present invention, the conical body is fabricated from a predominately carbon matrix material. In a preferred embodiment of this invention, the conical housing 62 is also fabricated from a predominately carbon matrix material. The conical body 61 is driven from the engine by a drive gear 63. A conical rotary valve will have at least one port through it. In the design shown in FIG. 5, the conical body 61 has an inlet port 64 extending from the base 75 of the conical body 61 through to the top 76 and communicating with an inlet manifold 65. FIG. 5 further shows an exhaust port 66 extending from the base 75 through the conical body 61 to the side 77 where it communicates with the exhaust manifold 67. However, different embodiments of the same general conical rotary valve design could use fewer or more ports than shown. The conical housing 62 sits atop or is part of the cylinder head 68 and the cylinder 69. The cylinder 69 and the cylinder head 68 form a combustion chamber 70. Through the conical housing 62 and the cylinder head 68 is a combustion chamber port 71. As the conical body 61 rotates, the inlet port 64 and the exhaust port 66 are at different times exposed to the combustion chamber port 71 thereby allowing fuel and air to be drawn in and expelled from the combustion chamber 70.

The novelty of the conical rotary valve described above is the fact that it is fabricated from a predominately carbon matrix material. As with the open-cylinder rotary valve body described above, the conical body 61 is best fabricated from a knitted or braided or warp-interlock tube having continuous carbon fibers throughout the three-dimensional structure. However, it may also be formed from woven carbon fiber cloth or cast from a carbonaceous matrix system. The processing steps described above also apply here for curing, densification, self-lubrication treatment, and anti-oxidation treatment.

In a preferred embodiment of this invention, the conical housing 62 is also formed from a predominately carbon matrix material, using the fabrication methods described above. In another preferred embodiment of this invention, radial seals 72 are formed around the conical body 61. FIG. 2 shows the detail of such a seal, which is described more fully above. In another preferred embodiment of this invention, vanes 73 are formed in the inlet port 64 in order to improve atomization and swirl.

Figure 6:
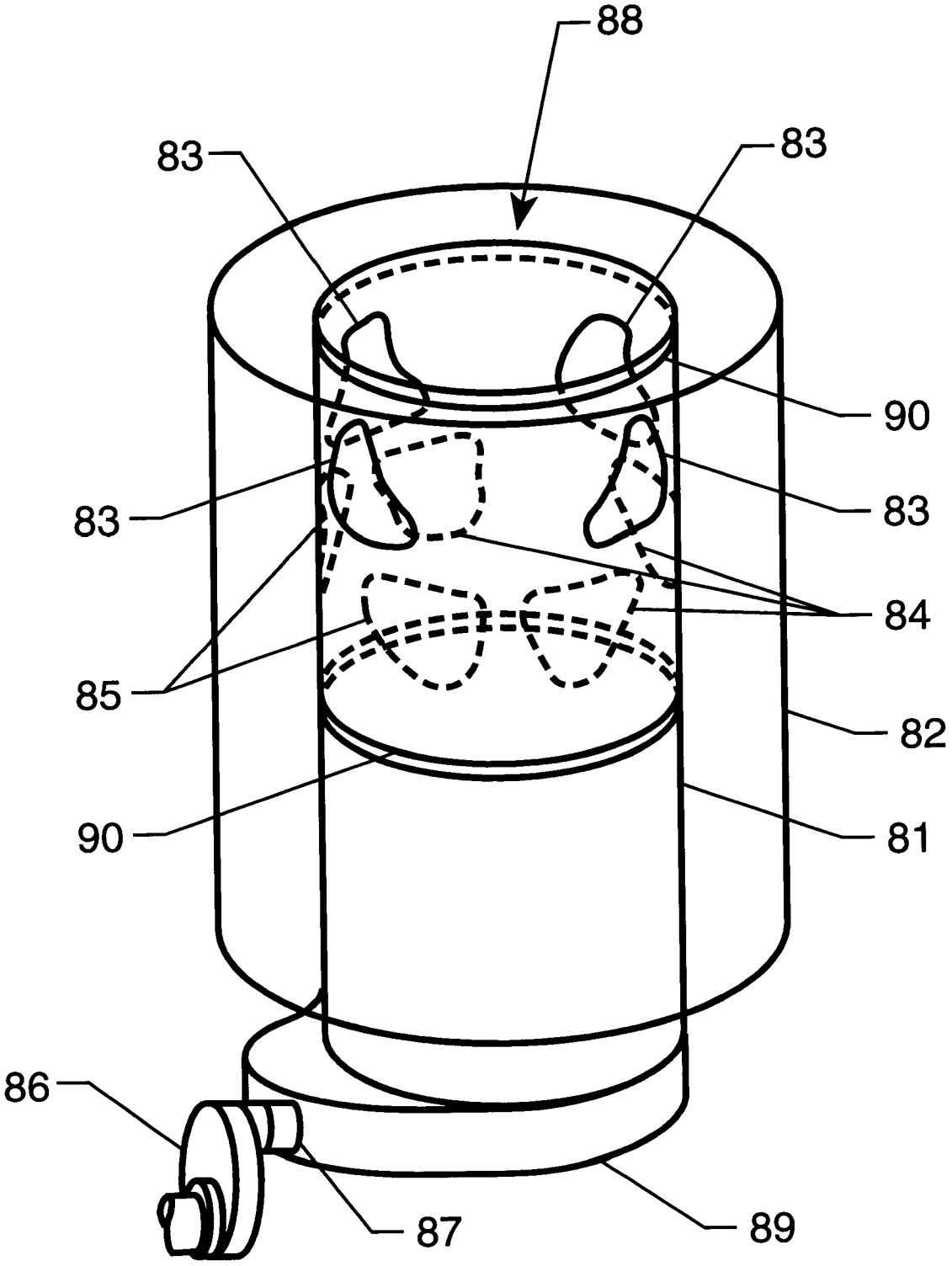
FIG. 6 is a partially sectioned side view of a sleeve valve fabricated according to the disclosed invention.

FIG. 6 shows a sleeve valve. The sleeve valve is comprised of a sleeve 81 which is rotatably and reciprocatably fitted in a sleeve jacket 82. According to the present invention , the sleeve 81 is fabricated from a predominately carbon matrix material. In a preferred embodiment of this invention, the sleeve jacket 82 is also fabricated from a predominately carbon matrix material. The sleeve 81 forms the engine's cylinder in which the piston (not shown) reciprocates. The sleeve 81 has a plurality of sleeve ports 83. The sleeve jacket has a plurality of inlet ports 84 and exhaust ports 85. The sleeve has a top end 88 and a base 89. The base 89 is connected by a crank pin 87 to a crank 88 which is driven by the engine. As the crank 88 rotates the sleeve 81 is forced to reciprocate as well as rotate in the sleeve jacket 82, causing the sleeve ports 83 to align at specified times with the inlet ports 84 and the exhaust ports 85, thereby allowing fuel and air to be drawn in and expelled from the sleeve cylinder 81.

The novelty of the sleeve valve described above is the fact that it is fabricated from a predominately carbon matrix material. As with the open-cylinder rotary valve body described above, the sleeve 81 is best fabricated from a knitted or braided or warp-interlock tube having continuous carbon fibers throughout the three-dimensional structure. However, it may also be formed from woven carbon fiber cloth or cast from a carbonaceous matrix system. The processing steps described above also apply here for curing, densification, self-lubrication treatment, and anti-oxidation treatment.

In a preferred embodiment of this invention, the sleeve jacket 82 is also formed from a predominately carbon matrix material, using the fabrication methods described above. In another preferred embodiment of this invention, radial seals 90 are formed around the sleeve 81. FIG. 2 shows the detail of such a seal, which is described more fully above.

Figure 7:
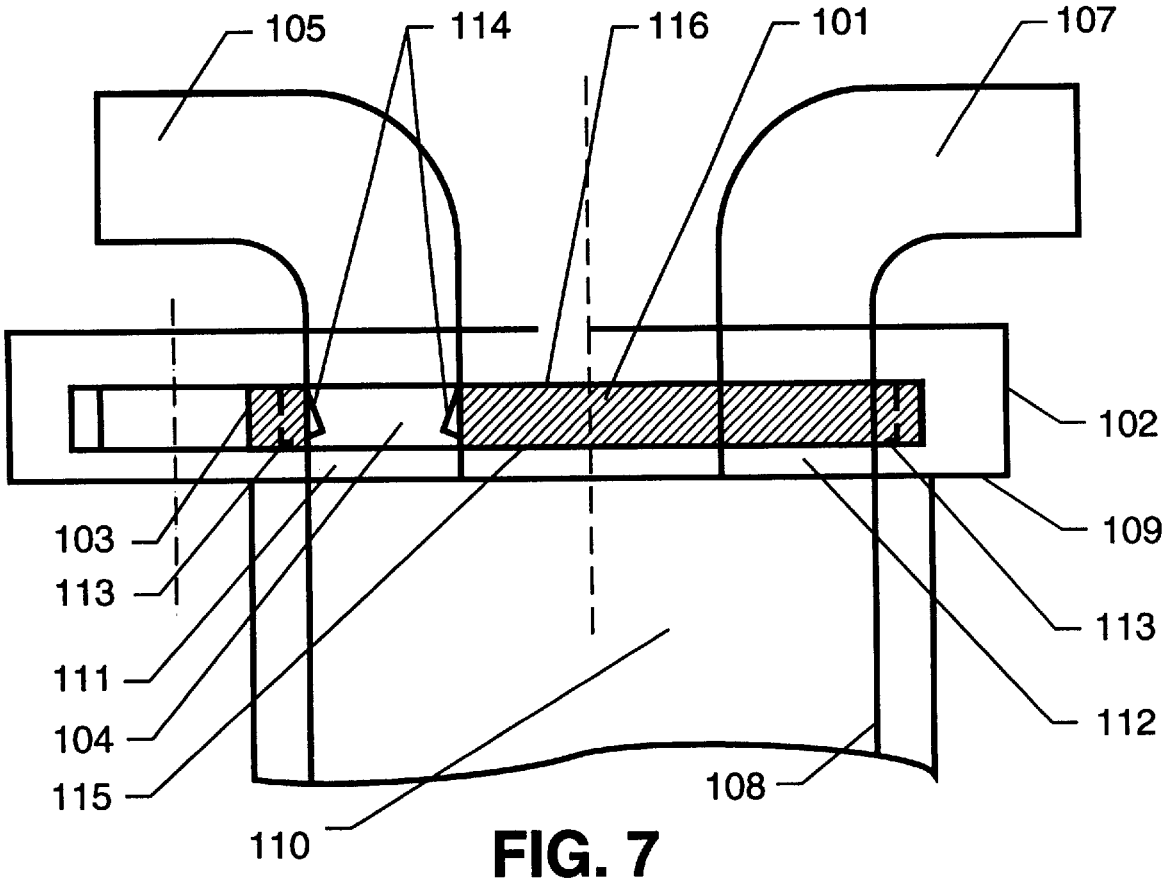
FIG. 7 is a cross-section side view of a disc valve fabricated according to the disclosed invention.
Figure 8:
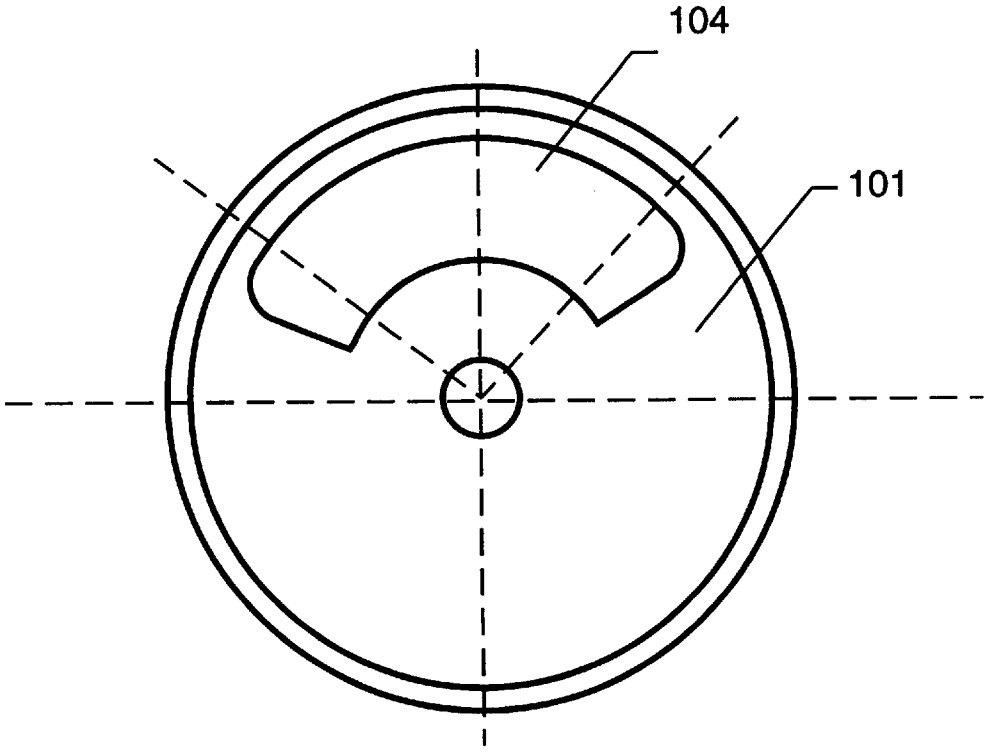
FIG. 8 is an over-head view of a disc valve fabricated according to the disclosed invention.

FIGS. 7 and 8 show different views of a distinct type of rotary valve, this one being a disc design. The design has a disc body 101 rotatably seated in a disc housing 102. According to the present invention, the disc body 101 is fabricated from a predominately carbon matrix material. In a preferred embodiment of this invention, the disc housing 102 is also fabricated from a predominately carbon matrix material. The disc body 101 is driven from the engine by a drive gear 103. A disc valve will have at least one port 104 through it. The disc housing 102 sits atop or is part of the cylinder head 109 and the cylinder 108. The cylinder 108 and cylinder head 109 form a combustion chamber 110. Through the combustion chamber side 115 of the disc housing 102 and the cylinder head 109 are an inlet combustion chamber port 111 and an exhaust combustion chamber port 112, and on the other side 116 of the disc housing 102 and the cylinder head 109 are an inlet manifold 105 and an exhaust manifold 107. As the disc body 101 rotates, the port 104 exposes at different times the inlet port 111 to the inlet manifold 105 and the exhaust port 112 to the exhaust manifold 107, thereby allowing fuel and air to be drawn in and expelled from the combustion chamber 110.

The novelty of the disc valve described above is the fact that it is fabricated from a predominately carbon matrix material. As with the open-cylinder rotary valve body described above, the disc body 101 is best fabricated from a knitted or braided or warp-interlock tube having continuous carbon fibers throughout the three-dimensional structure. However, it may also be formed from woven carbon fiber cloth or cast from a carbonaceous matrix system. The processing steps described above also apply here for curing, densification, self-lubrication treatment, and anti-oxidation treatment.

In a preferred embodiment of this invention, the disc housing 102 is also formed from a predominately carbon matrix material, using the fabrication methods described above. In another preferred embodiment of this invention, at least one radial seal 113 is formed in the combustion chamber side 115 of the disc body 101. FIG. 2 shows the detail of such a seal, which is described more fully above. In another preferred embodiment of this invention, vanes 114 are formed in the port 104 in order to improve atomization and swirl.

Although specific embodiments of the invention have been described herein, they are to be considered exemplary of the novel features thereof and are not exhaustive. There are obviously many variations and modifications of these specific examples that will be readily apparent to those skilled in the art in light of the above teachings without departing from the spirit or scope of the appended claims. It is therefore to be understood that the invention may be practiced otherwise than is specifically described.

We claim:

1. A finished or preform open-cylinder rotary valve for an internal combustion engine or the like comprising a cylinder having an outside surface and further having at least one open end and having at least one chamber in communication with the open end and a port in the cylinder opening into the chamber wherein said open-cylinder rotary valve is formed from a predominately carbon matrix material, said outer surface further comprising at least one seal, said seal being formed from a radially disposed slot about said outside surface, said slot forming a radially disposed tang, said tang having a portion extending above said outside surface.

2. A finished or preform closed-cylinder rotary valve for an internal combustion engine or the like comprising a cylinder having an outer surface, said outer surface having at least one recess means for fluid communication between a combustion chamber and a manifold, wherein said closed-cylinder rotary valve is formed from a predominately carbon matrix material, said outer surface further comprising at least one seal, said seal being formed from a radially disposed slot about said outside surface, said slot forming a radially disposed tang, said tang having a portion extending above said outside surface.

* * * * *